US007115549B2

(12) United States Patent
Dixon et al.

(10) Patent No.: US 7,115,549 B2
(45) **Date of Patent: *Oct. 3, 2006**

(54) COMPOSITION COMPRISING MACROCYCLIC TETRA-AMIDO METAL COMPLEX AS BLEACHING CATALYST

(75) Inventors: Sarah Dixon, Wirral (GB); Peter Leslie Gratton, Swellendam (ZA); John Oakes, Winsford (GB)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/485,624

(22) PCT Filed: Jul. 30, 2002

(86) PCT No.: PCT/EP02/08536

§ 371 (c)(1),
(2), (4) Date: Nov. 30, 2004

(87) PCT Pub. No.: WO03/014279

PCT Pub. Date: Feb. 20, 2003

(65) Prior Publication Data

US 2005/0075262 A1 Apr. 7, 2005

(30) Foreign Application Priority Data

Aug. 2, 2001 (GB) ..... 0118934.9
Feb. 19, 2002 (GB) ..... 0203928.7

(51) Int. Cl.
*C11D 1/22* (2006.01)
*C11D 3/20* (2006.01)
*C11D 3/26* (2006.01)

(52) U.S. Cl. ..... 510/311; 510/351; 510/499; 510/501; 502/200; 502/324; 502/325

(58) Field of Classification Search ..... 510/311, 510/336, 337, 351, 376, 501; 502/200, 207
See application file for complete search history.

(56) References Cited

U.S. PATENT DOCUMENTS

| | | | | |
|---|---|---|---|---|
| 4,577,042 | A * | 3/1986 | Collins et al. | 564/158 |
| 5,445,755 | A * | 8/1995 | Convents et al. | 510/305 |
| 5,847,120 | A | 12/1998 | Collins et al. | |
| 5,853,428 | A * | 12/1998 | Collins et al. | 8/107 |
| 5,876,625 | A * | 3/1999 | Collins et al. | 252/186.33 |
| 6,011,152 | A * | 1/2000 | Gordon-Wylie et al. | 540/474 |
| 6,022,490 | A | 2/2000 | Hermant et al. | |
| 6,051,704 | A * | 4/2000 | Gordon-Wylie et al. | 540/465 |
| 6,099,586 | A * | 8/2000 | Collins et al. | 8/111 |
| 6,241,779 | B1 * | 6/2001 | Collins et al. | 8/111 |
| 6,242,409 | B1 * | 6/2001 | Appel et al. | 510/376 |
| 2002/0134965 | A1 | 9/2002 | Danjo | |

FOREIGN PATENT DOCUMENTS

| | | | |
|---|---|---|---|
| WO | WO98/39405 | * | 9/1998 |
| WO | WO 99/65905 | | 12/1999 |
| WO | WO 00/12667 | | 3/2000 |
| WO | WO 00/12808 | | 3/2000 |
| WO | WO 00/29537 | | 5/2000 |
| WO | WO 00/60045 | | 10/2000 |

* cited by examiner

*Primary Examiner*—Gregory R. Del Cotto
(74) *Attorney, Agent, or Firm*—Kirkpatrick & Lockhart Nicholson Graham LLP

(57) ABSTRACT

The present invention provides a laundry bleaching composition comprising: a) a macrocycilc tetra amido N-donor metal-ligand complex (preferably, 5,6-benzo-3,8,11,13-tetraoxo-2,2,9,9,12,12-hexamethyl-1,4,7,10-tetraaza-cyclotridecane), and b) an alkyl benzene sulphonate surfactant, said composition being substantially devoid of any added peroxygen bleach or a peroxy-based or peroxy-generating bleach system.

12 Claims, 1 Drawing Sheet

5

Figure 1:
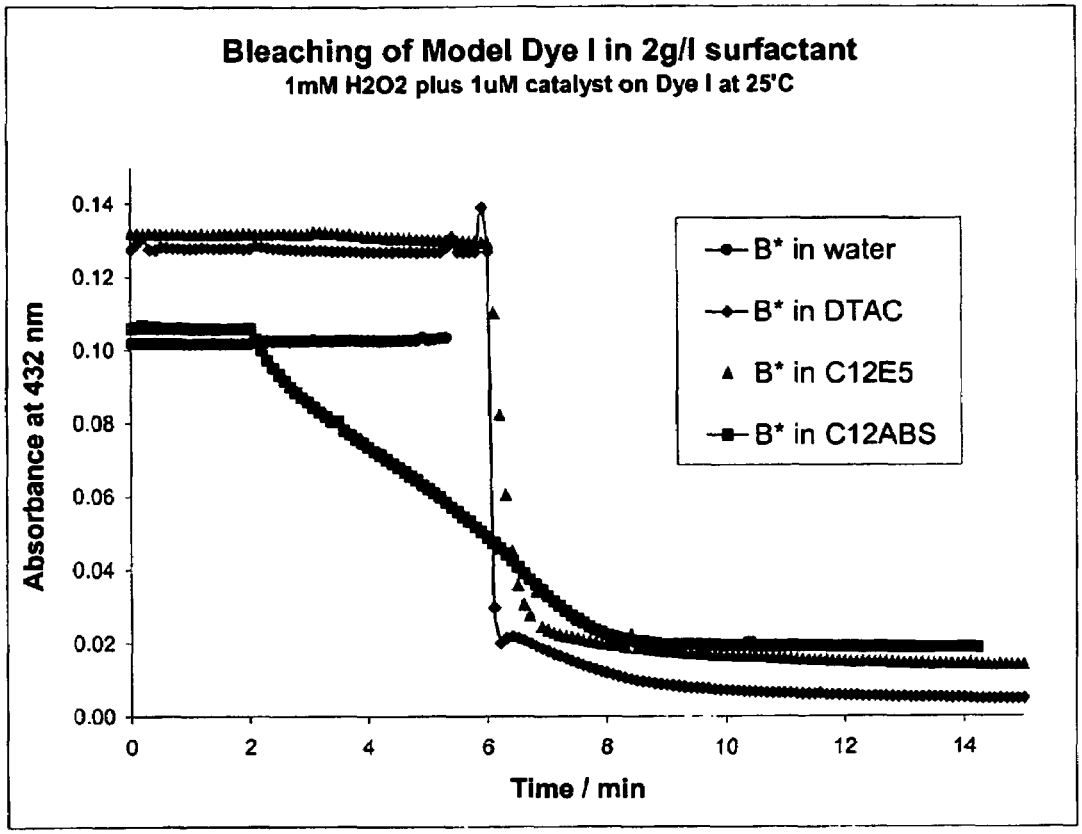

COMPOSITION COMPRISING MACROCYCLIC TETRA-AMIDO METAL COMPLEX AS BLEACHING CATALYST

CROSS REFERENCE TO RELATED APPLICATIONS

This application is the national stage application of International Application No. PCT/EP02/08536, filed 30 Jul. 2002, having an International Publication Number of WO 03/014279 A1 and an International Publication Date of 20 Feb. 2003, which claims priority from Great Britain Patent Applications Nos. 0118934.9, filed 2 Aug. 2001 and 0203928.7, filed 19 Feb. 2002.

TECHNICAL FIELD

The present invention relates to compositions comprising a macrocyclic tetra-amido N-donor metal-ligand complexes as a bleaching catalyst.

BACKGROUND OF THE INVENTION

Oxidation catalysts comprising metal-complexes are well known. Such catalysts have been proposed for use in laundry compositions as components of a bleaching system. These catalysts activate $H_2O_2$ or other peroxygen sources.

A particular catalyst is disclosed in WO 98/03263, filed 21 Jul. 1997, (Collins et al.), which comprises a macrocyclic (tetra) amido N-donor. The macrocycle is capable of complexing with a metal ion, for example an iron III or IV. The complex also comprises axial ligands and one or more counter ions.

One proposed purpose of these catalysts has been to assist in the bleaching of dyestuffs released from articles being laundered. If these dyestuffs are not removed from the wash liquor then they will re-deposit onto articles and cause a loss of colour definition or even catastrophic damage to 'white' articles. U.S. Pat. No. 5,853,428, filed 24 Feb. 1997, (Collins et al.) discloses use of similar catalysts in laundry detergent compositions. In both these citations the addition of hydrogen peroxide, or a source thereof, is envisaged as a means of activating the catalyst.

Bleaching agents typically present in laundry detergents include percarbonates and/or perborates, which can also act as sources of hydrogen peroxide and/or other peroxyl species.

Bleaching catalysts capable of bleaching effectively in the absence of added peroxyl sources have recently become the focus of some interest, for example: WO9965905; WO0012667; WO0012808; WO0029537, and, WO0060045. It is believed that these catalysts have the capability to use atmospheric oxygen as a source of oxidising equivalents.

SUMMARY OF THE INVENTION

Surprisingly, we have found that dyes can be decolourised by a macrocyclic tetra amido N-donor metal-ligand complex in the absence of added hydrogen peroxide provided that a commercial alkyl benzene sulphonate surfactant is present.

Accordingly, the present invention provides a bleaching composition comprising:

a) a macrocyclic tetra amido N-donor metal-ligand complex, and, b) an alkyl benzene sulphonate surfactant.

said composition being substantially devoid of any added peroxygen bleach or a peroxy-based or peroxyl-generating bleach system.

It is particularly advantageous to be able to bleach dyestuffs without the addition of hydrogen peroxide or a source thereof to the composition. Not only does this have savings in terms of cost, but it also removes some of the limitations on formulation which would be brought about by the presence of hydrogen peroxide.

The mechanism of the invention is not fully understood. While bleaching occurs (in the absence of added hydrogen peroxide) in the presence of an alkyl benzene sulphonate (ABS) surfactant, it does not occur if the ABS is replaced with an ethoxylated alcohol nonionic surfactant. It is unclear whether some component of the ABS is acting as a primary substrate for the catalyst or whether the oxidising equivalents are eventually derived from atmospheric oxygen.

A possible explanation is that relatively slow air oxidation of ABS leads to the formation of hydroperoxides. In the presence of the catalyst these act as a substrate enabling the oxidation of dyestuffs. The term "substantially devoid of any added peroxygen bleach or a peroxy-based or peroxyl-generating bleach system" should therefore be construed within the spirit of the invention. It is preferred that, other than as a component of the surfactant, the composition has as low a content of peroxyl species present as possible.

The present invention extends to a method of bleaching a substrate comprising applying to the substrate, in an aqueous medium, the bleaching composition according to the present invention.

The present invention extends to a commercial package comprising the bleaching composition according to the present invention together with instructions for its use.

The bleaching composition may be contacted to the textile fabric in any suitable manner. For example, it may be applied in dry form, such as in powder form, or in a liquor that is then dried, for example as an aqueous spray-on fabric treatment fluid or a wash liquor for laundry cleaning, or a non-aqueous dry cleaning fluid or spray-on aerosol fluid.

Any suitable textile that is susceptible to bleaching or one that one might wish to subject to bleaching may be used. Preferably the textile is a laundry fabric or garment.

In a preferred embodiment, the method according to the present invention is carried out on a laundry fabric using an aqueous treatment liquor. In particular, the treatment may be effected in a wash cycle for cleaning laundry.

The bleaching method may be carried out by simply leaving the substrate in contact with the bleaching composition for a sufficient period of time. Preferably, however, the bleaching composition is in an aqueous medium, and the aqueous medium on or containing the substrate is agitated.

In a particularly preferred embodiment the method according to the present invention is carried out on a laundry fabric using aqueous treatment liquor. In particular the treatment may be effected in, or as an adjunct to, an essentially conventional wash cycle for cleaning laundry. More preferably, the treatment is carried out in an aqueous detergent wash liquor. The bleaching composition can be delivered into the wash liquor from a powder, granule, pellet, tablet, block, bar or other such solid form. The solid form can comprise a carrier, which can be particulate, sheet-like or comprise a three-dimensional object. The carrier can be dispersible or soluble in the wash liquor or may remain substantially intact. In other embodiments, the bleaching composition can be delivered into the wash liquor from a paste, gel or liquid concentrate.

A unit dose as used herein is a particular amount of the bleaching composition used for a type of wash. The unit dose may be in the form of a defined volume of powder, granules or tablet.

DETAILED DESCRIPTION OF THE INVENTION

In order that the invention may be further understood it is described below with reference to certain preferred features.

The Surfactant:

As noted above, the surfactant comprises an alkyl benzene sulphonate. Suitable alkyl benzene sulphonate compounds which may be used are water-soluble alkali metal salts of organic sulphonates having alkyl radicals containing from about 8 to about 22 carbon atoms, the term alkyl being used to include the alkyl portion of higher acyl radicals. Particularly preferred surfactant compounds are sodium and potassium alkyl $C_9$–$C_{20}$ benzene sulphonates, particularly sodium linear secondary alkyl $C_{10}$–$C_{15}$ benzene sulphonates. The most preferred anionic detergent compounds are sodium $C_{11}$–$C_{15}$ alkyl benzene sulphonates.

Other surfactants may be present in the compositions of the invention. Preferably these are anionic surfactants. Examples of suitable synthetic anionic surfactants include:

- sodium and ammonium alkyl sulphates, especially those obtained by sulphating higher ($C_8$–$C_{18}$) alcohols produced, for example, from tallow or coconut oil;
- sodium alkyl glyceryl ether sulphates, especially those ethers of the higher alcohols derived from tallow or coconut oil fatty acid mono-glyceride sulphates and sulphonates;
- sodium and ammonium salts of sulphuric acid esters of higher ($C_9$–$C_{18}$) fatty alcohol alkylene oxide, particularly ethylene oxide, reaction products;
- the reaction products of fatty acids such as coconut fatty acids esterified with isethionic acid and neutralised with sodium hydroxide;
- sodium and ammonium salts of fatty acid amides of methyl taurine;
- alkane mono-sulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate;
- sodium and ammonium ($C_7$–$C_{12}$) dialkyl sulphosuccinates; and;
- olefin sulphonates, which term is used to describe material made by reacting olefins, particularly ($C_{10}$–$C_{20}$) alpha-olefins, with $SO_3$ and then neutralising and hydrolysing the reaction product.

Preferred levels of anionic surfactant are 1–30% wt on product, preferably 3–10% wt on product.

The compositions of the invention may also comprise nonionic surfactants. As will be discussed below, the nonionic surfactants do not appear to act as substrates for the catalyst. Moreover, it is believed that even in the presence of anionic surfactant the catalysts become less effective as the level of nonionic is increased. However low levels of nonionic surfactants can be present to confer cleaning benefits.

Preferably, the level of nonionic surfactant in the composition is less than 5% wt.

Examples of suitable nonionic surface-active compounds which may be used, preferably together with the anionic surface-active compounds, include, in particular;

- the reaction products of alkylene oxides, usually ethylene oxide, with alkyl ($C_6$–$C_{22}$) phenols, generally 5–25 EO, i.e. 5–25 units of ethylene oxides per molecule; and;
- the condensation products of aliphatic ($C_8$–$C_{18}$) primary or secondary linear or branched alcohols with ethylene oxide, generally 2–30 EO.

Other so-called nonionic surface-actives include alkyl polyglycosides, sugar esters, long-chain tertiary amine oxides, long-chain tertiary phosphine oxides and dialkyl sulphoxides.

Preferably the surfactant is present in the composition in an amount such that a unit dose provides at least 0.05, more preferably 0.1, most preferably 0.2 g/l concentration of the surfactant compound in a wash.

The Bleach Catalyst:

The amount of catalyst in the detergent composition is typically sufficient to provide a concentration in the wash liquor of generally 0.005 μm to 100 μm, preferably from 0.025 μM to 50 μM, more preferably from 0.05 μM to 10 μM.

Preferred ligands are un-bridged tetra-amido complexes.

Preferred metal-complexed ligands are those having the structure as shown in general formula 1:

General formula 1:

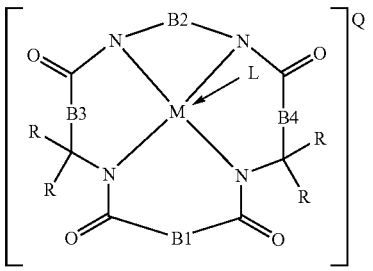

wherein:

$B_1$, $B_3$ and $B_4$ each represent a bridging group having zero, one two or three carbon containing nodes for substitution, and $B_2$ represents a bridging group having at least one carbon containing node for substitution, each said node containing a C(R), $C(R_1)(R_2)$ or $C(R)_2$, each R substituent is the same is the same or different from the remaining R substituents, and (i) is selected from the group consisting of alkyl, alkenyl, cycloalkyl, cycloalkenyl, aryl, alkynyl, alkylaryl, halogen, alkoxy, phenoxy and combinations thereof, or (ii) form a substituted or unsubstituted benzene ring of which two carbons on the ring form nodes in the B-unit;

M is a transition metal ion;

L is an axial ligand; and,

Q is an alkali metal or tetra-alkyl ammonium or tetraphenyl phosphonium counter-ion.

Preferably, the axial ligand is selected from the group consisting of water and halide. Particularly preferred axial ligands are water and chloride.

It is within the scope of the present invention to have a bleach activator, wherein M is selected from the group consisting of Fe, Mn, Cr, Cu, Co, Ni, Mo, V, Zn and W.

The most preferred catalyst is that in which the ligand is 5,6-benzo-3,8,11,13-tetraoxo-2,2,9,9,12,12-hexamethyl-1,4,7,10-tetraaza-cyclo-tridecane.

The axial ligand 'L' is water or preferably chloride. The counter-ion 'Q' is preferably lithium. The ligand is also known as 3,4,8,9-tetrahydro-3,3,6,6,9,9-hexa-methyl-1H-1,4,8,11-benzotetraazocyclotridecane-2,5,7,10(6H, 11H) tetrone.

In addition to the catalyst it is possible to include an enhancer in the composition. Preferably the enhancers are nitrogen-containing organic molecules. More preferably, the enhancer compounds are of the general formula one, shown below:

General Formula One:

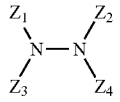

wherein:

$Z_1$ and $Z_2$ are electron-withdrawing groups, independently selected from the group consisting of optionally substituted alkyl/(hetero) (poly)aryl-, -sulfone, -sulfoxide, -sulfonate, -carbonyl, -oxalyl, -amidoxalyl, -hydrazidoxalyl, -carboxyl and esters and salts thereof, -amidyl, -hydrazidyl, and nitrile.

$Z_3$ and $Z_4$ are hydrogen, or are absent when the bonding between $Z_1$ or $Z_2$ and the adjacent nitrogen in the general form is a pi-bond.

In preferred enhancers $Z_3$ and $Z_4$ are both hydrogen (thereby forming a hydrazino compound), or $Z_3$ and $Z_4$ are both absent (thereby forming an azino compound).

Particularly preferred azino enhancers are molecules of the general formula given below:

'ABTS' =

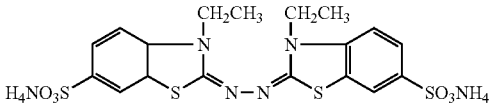

This molecule is known as 2,2'-Azino-bis(3-ethyl-benzthiazoline-6-sulphonate) diammonium salt. Its CA registry number is 30931-67-0.

Preferred hydrazino enhancers may contain one or more than one of the hydrazino structures. The general formulae of two particularly preferred enhancers are given below:

`Dimer`

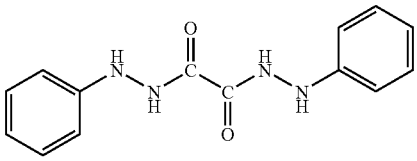

`ECHA`

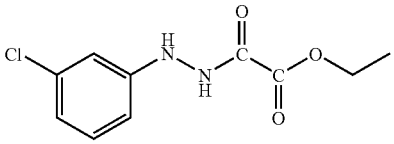

The structure of a further enhancer, which does not have the characteristic azino- or hydrazino-bond of the preferred embodiments discussed above is given below:

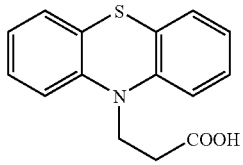

This is phenothiazine-10-propionate (PTP), as described in U.S. Pat. No. 5,451,337 and U.S. Pat. No. 5,445,755.

Other Components:

The composition may also contain a detergency builder, for example in an amount of from about 5 to 80% by weight, preferably from about 10 to 60% by weight. Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as;

sodium tripolyphosphate;

nitrilotriacetic acid and its water-soluble salts;

the alkali metal salts of carboxymethyloxy succinic acid, ethylene diamine tetraacetic acid, oxydisuccinic acid, mellitic acid, benzene polycarboxylic acids, citric acid; and;

polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP-A-0,384,070.

In particular, the composition may contain any one of the organic and inorganic builder materials, though, for environmental reasons, phosphate builders are preferably omitted or only used in very small amounts.

Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is advantageous for the compositions of the invention to comprise at least one nitrogen-containing, dye binding, DTI polymers. Of these polymers and co-polymers of cyclic amines such as vinyl pyrrolidone, and/or vinyl imidazole are preferred. Suitable polymers include polyvinyl pyrrolidone polymers, polyamine N-oxide polymers, copolymers of N-vinylpyrrolidone and N-vinylimidazole, and polymers of N-carboxymethyl-4-vinylpyridinium chloride. Most preferably the composition according to the present invention comprises a dye transfer inhibition agent selected from poly vinyl-pyrridine N-oxide (PVPy-NO), polyvinyl pyrrolidone (PVP), polyvinyl imidazole, N-vinylpyrrolidone and N-vinylimidazole copolymers (PVP/PVI), copolymers thereof, and mixtures thereof.

The amount of dye transfer inhibition agent in the composition according to the present invention will be from 0.01 to 10%, preferably from 0.02 to 5%, more preferably from 0.03 to 2%, by weight of the composition.

Apart from the components already mentioned, the composition can contain any of the conventional additives in amounts of which such materials are normally employed in fabric washing detergent compositions.

Examples of these additives include;

buffers such as carbonates;

lather boosters, such as alkanolamides, particularly the monoethanol amides derived from palmkernel fatty acids and coconut fatty acids;

lather depressants, such as alkyl phosphates and silicones;

anti-redeposition agents, such as sodium carboxymethyl cellulose and alkyl or substituted alkyl cellulose ethers;

stabilisers, such as phosphonic acid derivatives (i.e. Dequest® types);

fabric softening agents;

inorganic salts and alkaline buffering agents, such as sodium sulphate and sodium silicate;

and, usually in very small amounts, fluorescent agents; perfumes; enzymes, such as proteases, cellulases, lipases, amylases and oxidases; germicides and colourants.

In order that the invention may be further and better understood it will be described in detail with reference to following non-limiting examples and with reference to the accompanying figures wherein:

FIG. 1 shows absorbance vs. time for bleaching of a pure dye in solution.

EXAMPLES

The catalyst referred to in the examples is the Fe complex of 3,4,8,9-tetrahydro-3,3,6,6,9,9-hexamethyl-1H-1,4,8,11-benzotetraazocyclotri-decane-2,5,7,10 (6H, 11H) tetrone, with lithium as the counter-ion and water as the axial ligand.

This was synthesised in accordance with the method set out in our co-pending patent application GB 0020846.2.

FIG. 1 shows results in which with the conditions otherwise fixed, the surfactant type is varied. Conditions were: 1 uM catalyst, 1000 uM $H_2O_2$, 50 uM Dye 1 (arylazonaphthol dye, pure), 25° C., pH 10 borax buffer, +/−2 g/L surfactant.

The Surfactants Used Were:

'C12ABS': average C12 chain commercial alkylbenzene sulfonate 'purified' ex Aldrich 'C12E5': a pure ethoxylated alcohol, and, 'DTAC': dodecyl trimethylammonium chloride.

A control was performed in which water was used instead of the surfactant.

The catalyst solution is added to system at t=2 min and $H_2O_2$ at t=6 min. In the example with ABS no $H_2O_2$ was added at all, since the colour had already gone.

As will be noted from the figure, with both water or pure nonionic and cationic surfactants there was no significant bleaching by catalyst in absence of $H_2O_2$. In each of these cases the dyes was bleached over a short period (less than a minute) once the hydrogen peroxide was added.

In the case of the ABS surfactant, bleaching of the dye commenced as soon as the dye was added, i.e. before the addition of peroxide. Bleaching of the dye reached an end point after around six minutes.

The invention claimed is:

1. A bleaching composition comprising:

a) an alkyl benzene sulphonate surfactant, and b) a macrocyclic tetra amido N-donor metal ligand complex, having the structure as shown below:

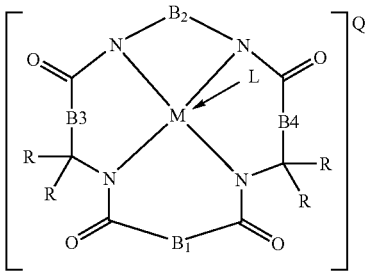

wherein:

$B_1$, $B_3$ and $B_4$ each represent a bridging group having zero, one two or three carbon containing nodes for substitution, and $B_2$ represents a bridging group having at least one carbon containing node for substitution, each said node containing a C(R), $C(R_1)(R_2)$ or $C(R)_2$, each R substituent is the same or different from the remaining R substituents, and (1) is selected from the group consisting of alkyl, alkenyl, cycloalkyl, cycloalkenyl, aryl, alkynyl, alkylaryl, halogen, alkoxy, phenoxy and combinations thereof, or (2) form a substituted or unsubstituted benzene ring of which two carbons on the ring form nodes in the B-unit;

M is a transition metal ion;

L is an axial ligand; and,

Q is an alkali metal or tetra-alkyl ammonium or tetraphenyl phosphonium counter-ion and, said composition being devoid of any added peroxygen bleach or a peroxy based or peroxyl-generating bleach system.

2. A bleaching composition according to claim 1 wherein the alkyl benzene sulphonate surfactant is present in the composition in an amount sufficient to provide a concentration in a wash liquor of at least 0.05 g/l.

3. A bleaching composition according to claim 1, wherein the macrocyclic tetra-amido N-donor metal-ligand complex catalyst is present in the composition in an amount sufficient to provide a concentration in a wash liquor of 0.005 μm to 100 μm.

4. A bleaching composition according to claim 1 wherein the axial ligand is selected from the group consisting of water and halide.

5. A bleaching composition according to claim 1, wherein M is selected from the group consisting of Fe, Mn, Cr, Cu, Go, Ni, Mo, V, Zn and W.

6. A bleaching composition according to claim 1 wherein the ligand is 5,6-benzo-3,8,11,13-tetraoxo-2,2,9,9,12,12-hexamethyl -1,4,7,10-tetraaza-cyclo-tridecane.

7. A bleaching composition according to claim 1 further comprising an enhancer comprised of a nitrogen-containing organic molecule.

8. A bleaching composition according to claim 7 wherein said enhancer is of the general formula

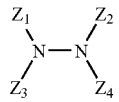

wherein $Z_1$ and $Z_2$ are electron withdrawing groups, independently selected from the group consisting of optionally substituted alkyl/(hetero) (poly)aryl-, -sulfone, -sulfoxide, -sulfonate, -carbonyl, -oxalyl, -amidoxalyl, -hydrazidoxalyl, -carboxyl and esters and salts thereof, -amidyl, hydrazidyl, and nitrile;

$Z_3$ and $Z_4$ are hydrogen or are absent when the bonding between one of $Z_1$ $Z_2$ and the adjacent nitrogen in the general formula is a pi-bond.

9. A bleaching composition according to claim 8 wherein the enhancer is a hydrazino compound.

10. A bleaching composition according to claim 8 wherein the enhancer is an azino compound.

11. A bleaching composition according to claim 10 wherein the azino compound is 2,2'-Azino-bis(3-ethyl-benzthiazoline-6-sulphonate) diammonium salt.

12. A bleaching composition according to claim 7 wherein the enhancer is phenothiazine-10-propionate.

* * * * *

UNITED STATES PATENT AND TRADEMARK OFFICE

CERTIFICATE OF CORRECTION

PATENT NO. : 7,115,549 B2
APPLICATION NO. : 10/485624
DATED : October 3, 2006
INVENTOR(S) : Sarah Dixon, Peter Leslie Gratton and John Oakes It is certified that error appears in the above-identified patent and that said Letters Patent is hereby corrected as shown below:

Col. 4, line 47 delete "is the same"

Col. 7, line 41 delete "uM" – and substitute therefor --μM--.

Col. 8, line 50 delete "Go" and substitute therefor --Co--.

Signed and Sealed this

Third Day of July, 2007

JON W. DUDAS
*Director of the United States Patent and Trademark Office*